US006460390B1

(12) United States Patent
Compagnoni et al.

(10) Patent No.: US 6,460,390 B1
(45) Date of Patent: Oct. 8, 2002

(54) ROLLING-MILL STAND WHICH CAN BE DISASSEMBLED INTO INTERCHANGEABLE MODULAR ELEMENTS

(75) Inventors: Bruno Monzio Compagnoni, Olgiate Olona (IT); Alberto Rigo, Legnamo (IT)

(73) Assignee: Techint Compagnia Technica Internazionale S.p.A., Milan (IT)

( * ) Notice: Subject to any disclaimer, the term of this patent is extended or adjusted under 35 U.S.C. 154(b) by 0 days.

(21) Appl. No.: 09/422,402

(22) Filed: Oct. 21, 1999

(30) Foreign Application Priority Data

Oct. 30, 1998 (IT) ..... MI98A2325

(51) Int. Cl.[7] ..... B21B 31/04
(52) U.S. Cl. ..... 72/238; 72/237
(58) Field of Search ..... 72/225, 238, 239

(56) References Cited

U.S. PATENT DOCUMENTS

| | | | | |
|---|---|---|---|---|
| 3,698,226 A | | 10/1972 | Eibe | |
| 3,805,572 A | | 4/1974 | Busch | |
| 3,866,454 A | * | 2/1975 | Muller | 72/238 |
| 4,329,864 A | | 5/1982 | Ledebur | |
| 4,368,633 A | | 1/1983 | Nogota | |
| 4,974,438 A | * | 12/1990 | Stubbins | 72/238 |
| 6,041,637 A | * | 3/2000 | Tashiro et al. | 72/239 |

FOREIGN PATENT DOCUMENTS

| | | |
|---|---|---|
| DE | 39 30 125 | 3/1991 |
| DE | 39 43 388 | 7/1991 |
| EP | 0 040 584 | 11/1981 |
| GB | 2114929 | 9/1983 |

* cited by examiner

*Primary Examiner*—Lowell A. Larson
(74) *Attorney, Agent, or Firm*—Hedman & Costigan, P.C.

(57) ABSTRACT

A rolling-mill stand comprises, in combination: at least two rolls (15) supported by respective mounts (16, 17) with adjustment and blocking tie rods (18, 19), supporting feet (20), and supports (20*a*). According to the invention, the said rolls (15) are mounted on a central module (11), whilst the corresponding mounts (16, 17), tie rods (18, 19), feet (20), and supports (20*a*) are mounted together in the form of two side modules (12, 13). A fast-clamping and fast-release system (21) is moreover provided for the stable but releasable connection between the said central module (11) and the said two side modules (12, 13).

1 Claim, 23 Drawing Sheets

ROLLING-MILL STAND WHICH CAN BE DISASSEMBLED INTO INTERCHANGEABLE MODULAR ELEMENTS

The present invention refers to a rolling-mill stand that can be disassembled into modular elements which are interchangeable with other equal or equivalent modules. The rolling-mill stand according to the invention characteristically has a structure such as to enable a simple and fast manoeuvre of replacement of the rolls, using an overhead travelling crane with a hoisting power that is even relatively low, like the ones normally present in all rolling mills.

In addition, the rolling-mill stand according to the invention can be conveniently and rapidly converted from a universal stand to a two-high stand.

The structure of a rolling-mill stand is well known to those skilled in the sector.

Rolling-mill stands of a known type are, for instance, described in the patents: GB-1,183,573, DE-1939485, DE-2506449, U.S. Pat. No. 3,882,710, U.S. Pat. No. 3,899,910, U.S. Pat. No. 3,908,426, U.S. Pat. No. 4,121,446, U.S. Pat. No. 4,715,206, EP-166478, EP-626218, and EP-A704256.

Such stands are generally made up of a so-called container, which supports the stand proper, and to which the stand proper is removably fixed.

The stand (referred to also as "core" or "cartridge") comprises the complex of rolls, mounts, tie rods, and supporting feet.

In a stand thus structured, the replacement of the worn rolls, or replacement for change of rolling "campaign", must be performed using two auxiliary systems, namely, an overhead travelling crane of adequate hoisting power, capable of taking the stand out of the rolling line, and a robot consisting of a piece of equipment for automatic roll change.

In fact, the replacement of the rolls takes place by translation, using a translator carriage, of the entire container-stand assembly off the rolling line, after which from the container-stand assembly, by means of an overhead travelling crane, just the stand is taken out, which is then deposited on a robot, where replacement of the rolls is carried out with disassembly and reassembly of the stand.

Again using an overhead travelling crane, the renewed stand is taken and positioned once again on the supporting container, and the container-stand assembly is brought back, via translator carriage, onto the rolling line.

As is well known to persons skilled in the field of rolling, in order to be able to carry out properly the entire sequence involved in the operations briefly summed up above, it is absolutely indispensable for the rolling mill to have available an overhead travelling crane having a hoisting power adequate for moving the entire assembly making up the stand, and, in addition, an auxiliary robot capable of carrying out the automatic roll change.

However, not all rolling mills have such equipment available, with the consequent evident inconvenience deriving therefrom for their procurement, both in terms of investments and in terms of arrangement of the plant in the existing space.

The general purpose of the invention is that of overcoming the drawbacks of the known art by making an improved stand having a structure such as to enable carrying-out of all the operations linked to roll change in a simple and fast manner, using the overhead travelling crane and the equipment of the type normally available in a traditional rolling mill.

A further purpose of the invention is to make a rolling-mill stand of the universal type that may be easily transformed into a two-high stand.

Yet another purpose of the invention is to make a fast-clamping and fast-release system between the core and the other components of the stand.

The present invention is concerned with a rolling-mill stand which comprises, in combination, at least two rolls (15) supported by mounts (16,17) having adjustment and blocking tie rods (18,19), supporting feet (20) and supports **(20*a*), wherein said rolls (15) are mounted on a central module (11), while the corresponding mounts (16,17), tie rods (18,19), feet (20) and supports (20*a*) are mounted together in the form of two side modules (12,13), there being provided a fast clamping and fast release system (21) for stable but separable, connection between said central module (11) and said side modules (12,13)**.

The structural and functional characteristics of the invention and its advantages with respect to the known art will be more clearly understandable from an examination of the ensuing description referring to the attached schematic drawings, which show examples of practical embodiments of the invention.

Figure 6:
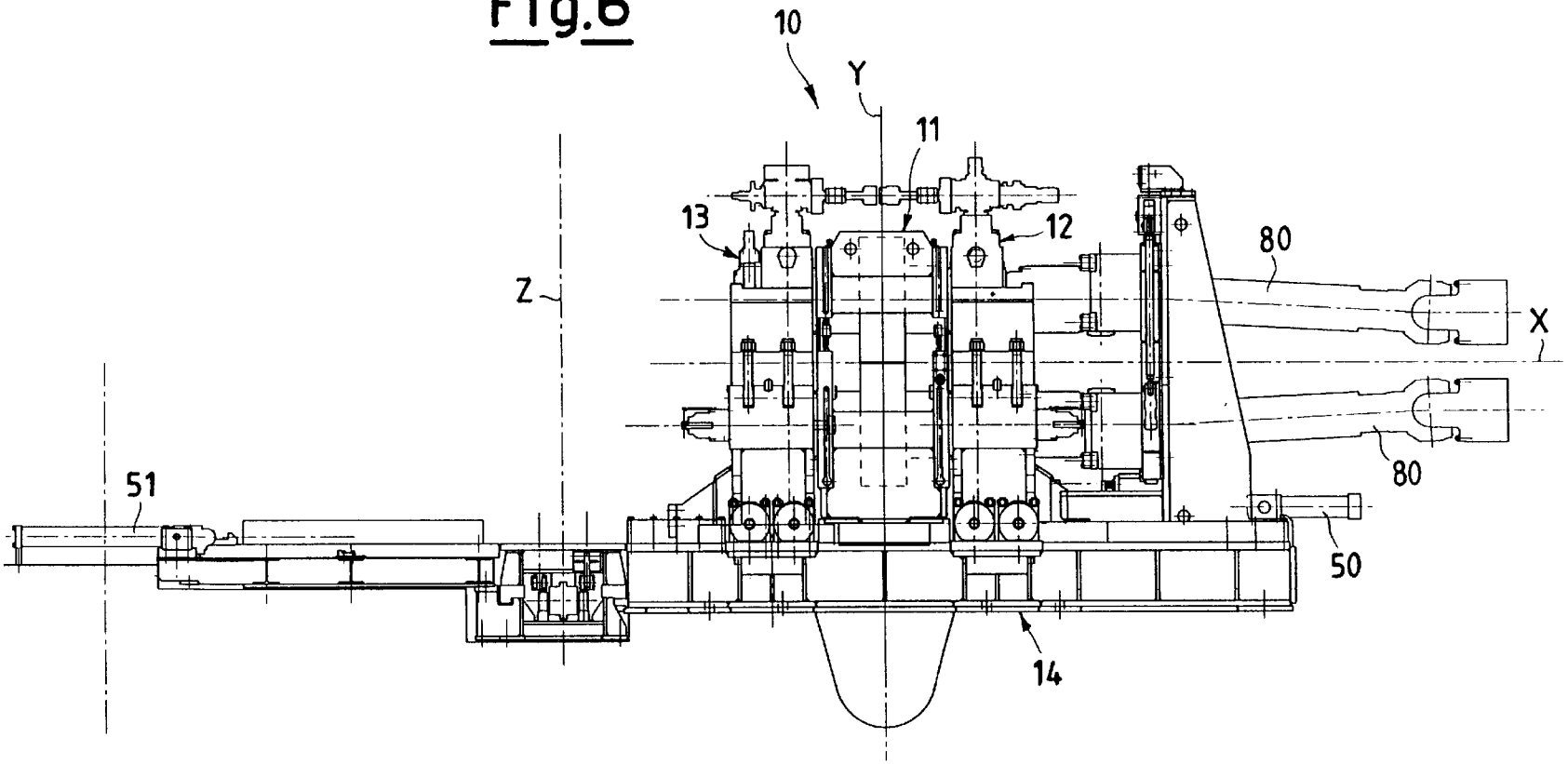
Figure 7:
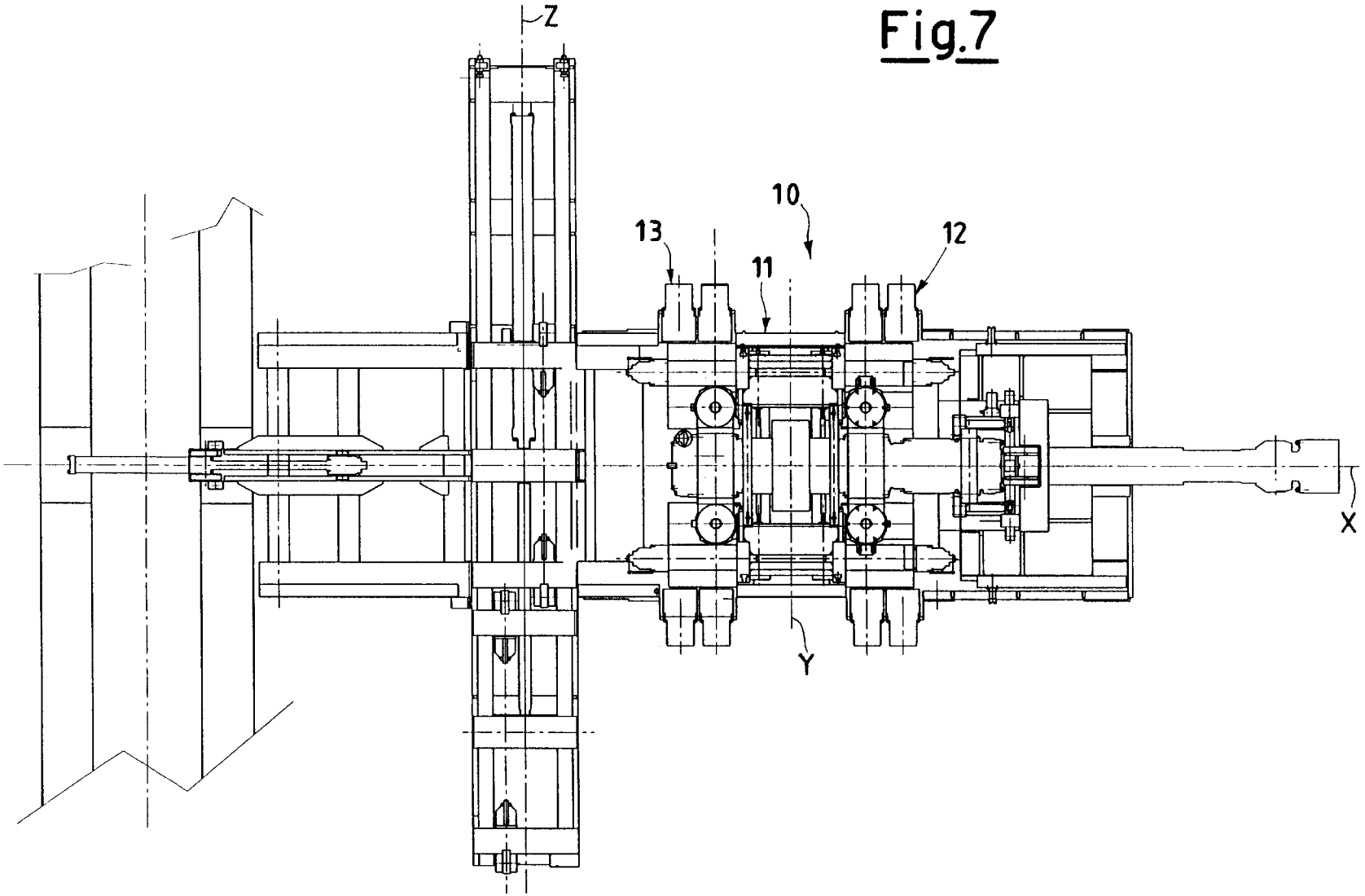
Figure 8:
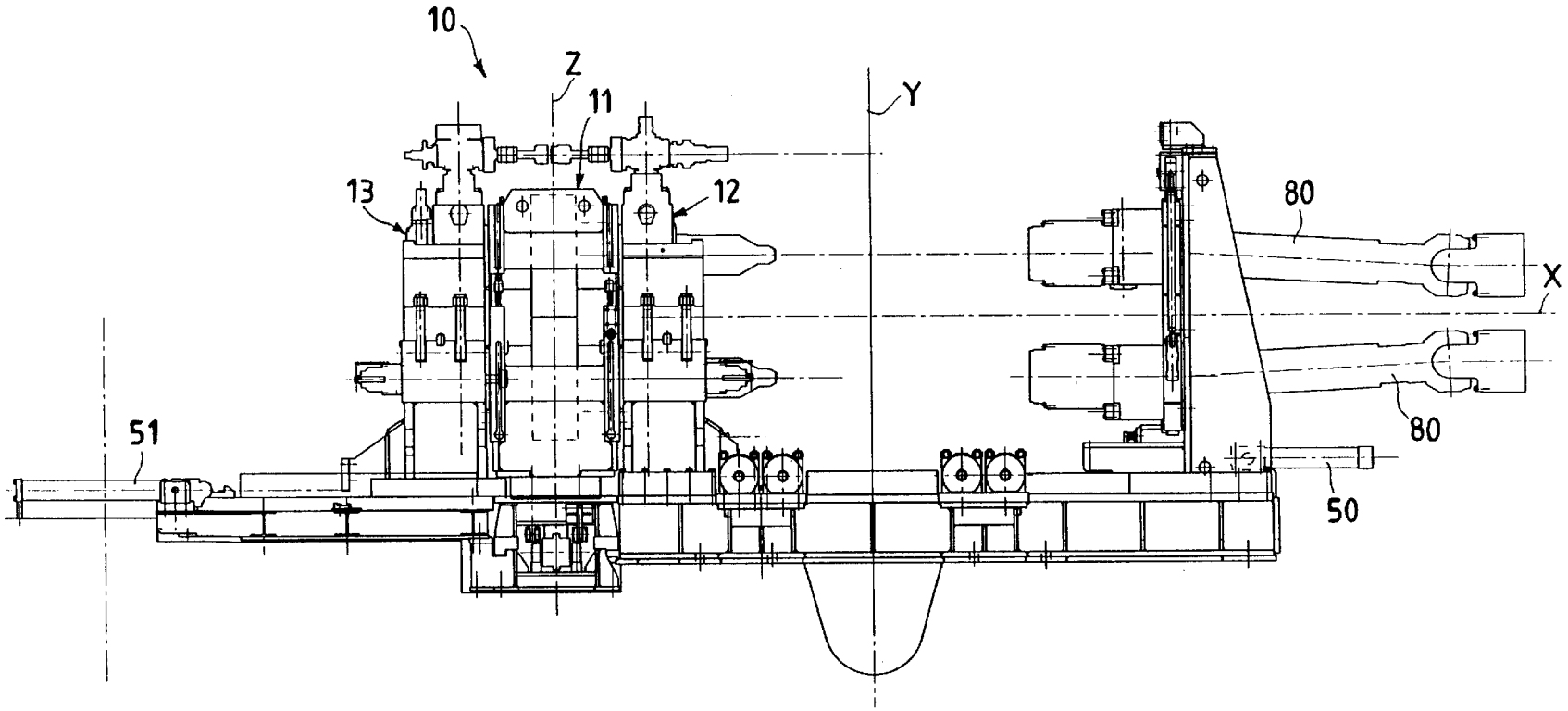
Figure 9:
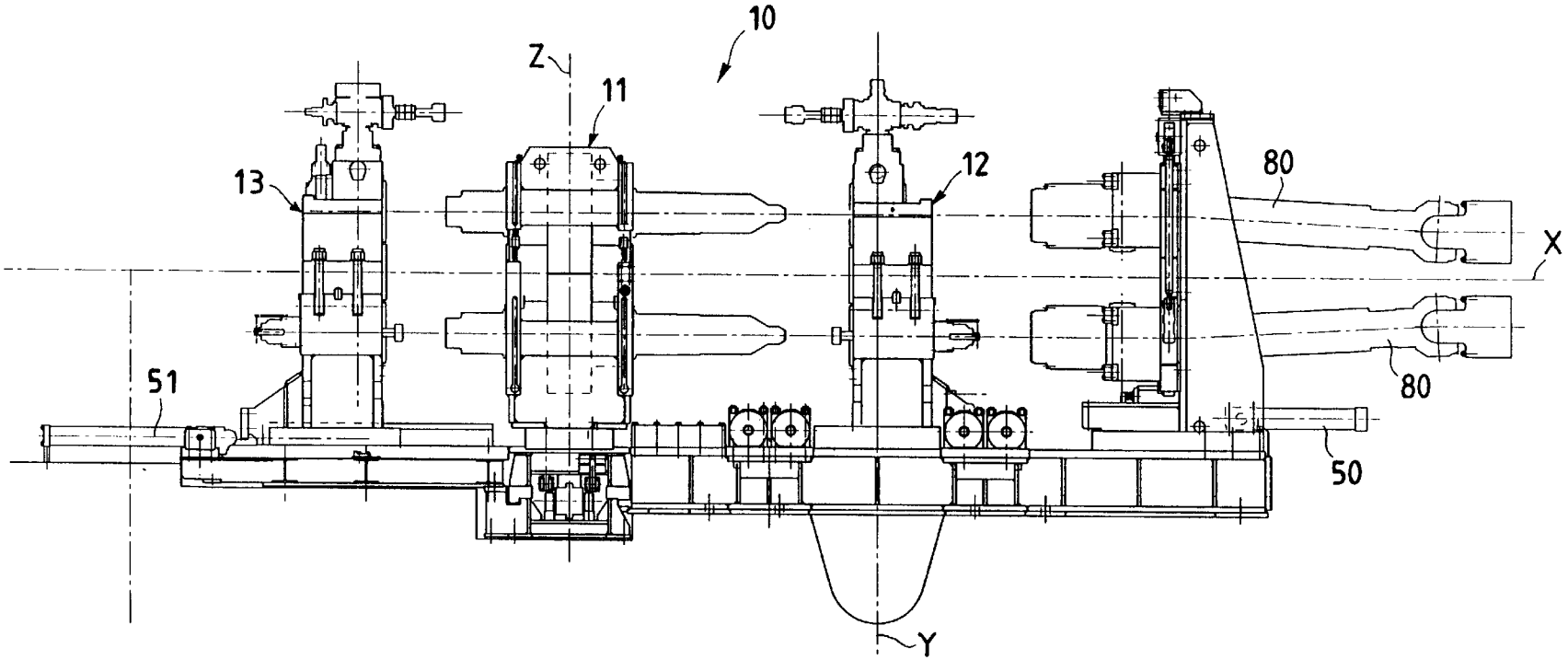
Figure 10:
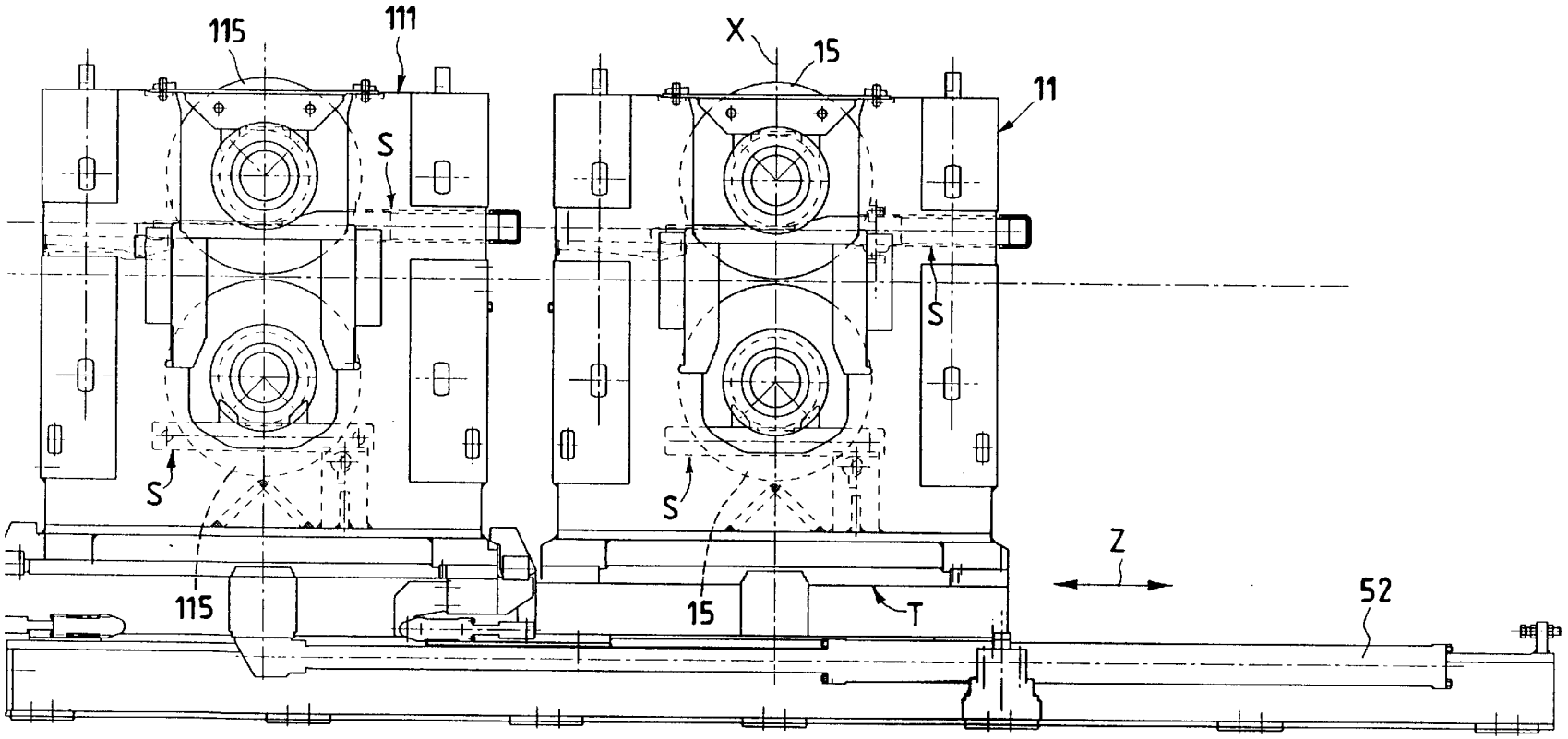
Figure 11:
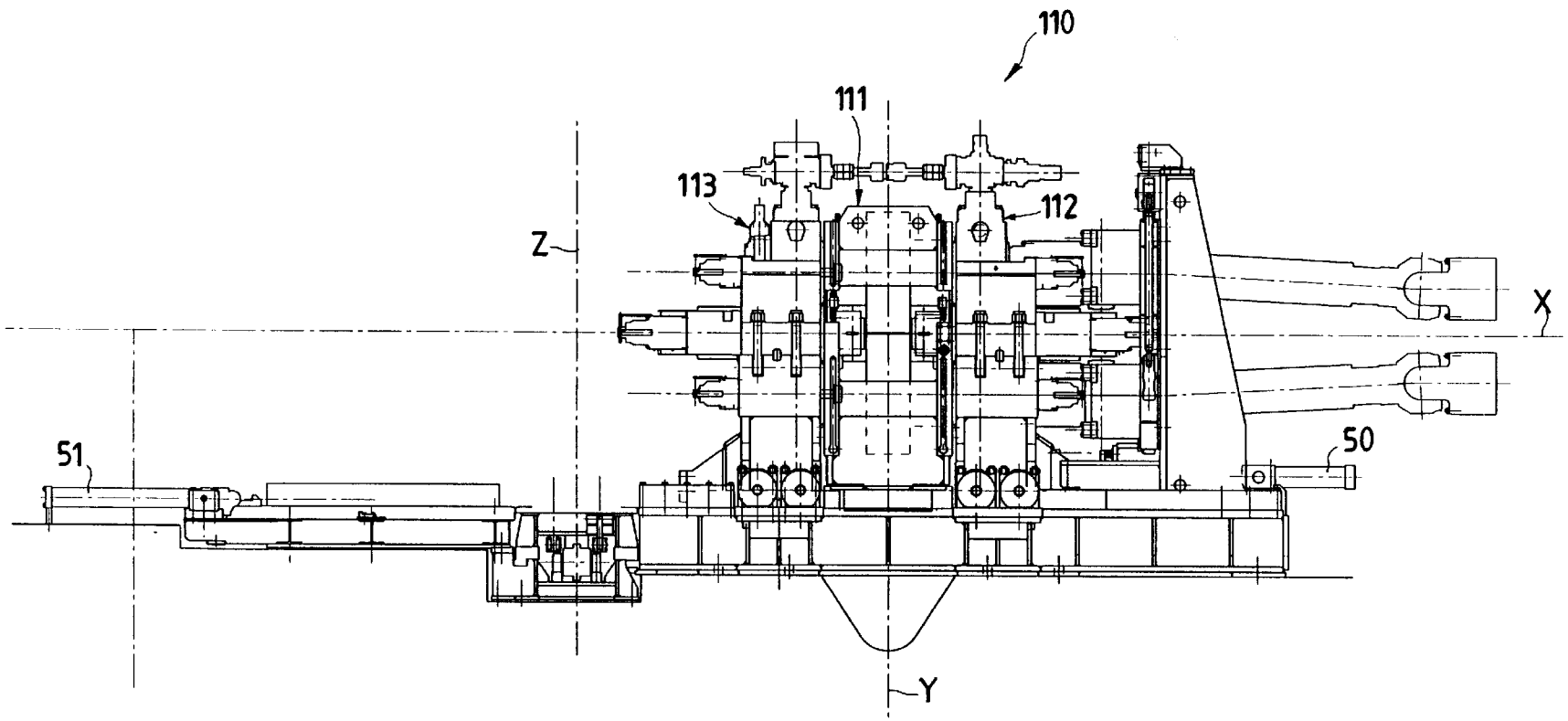
Figure 12:
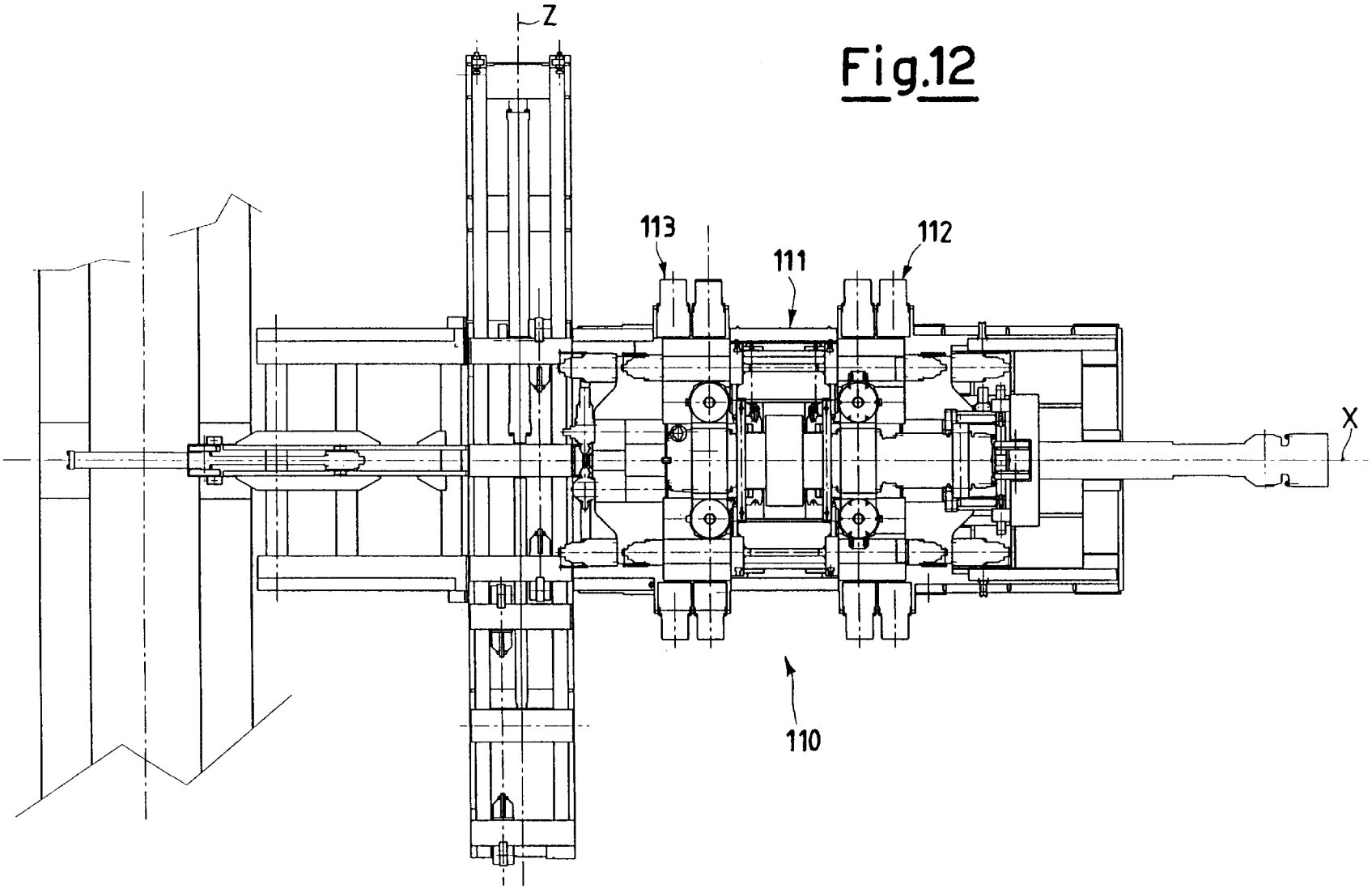
Figure 13:
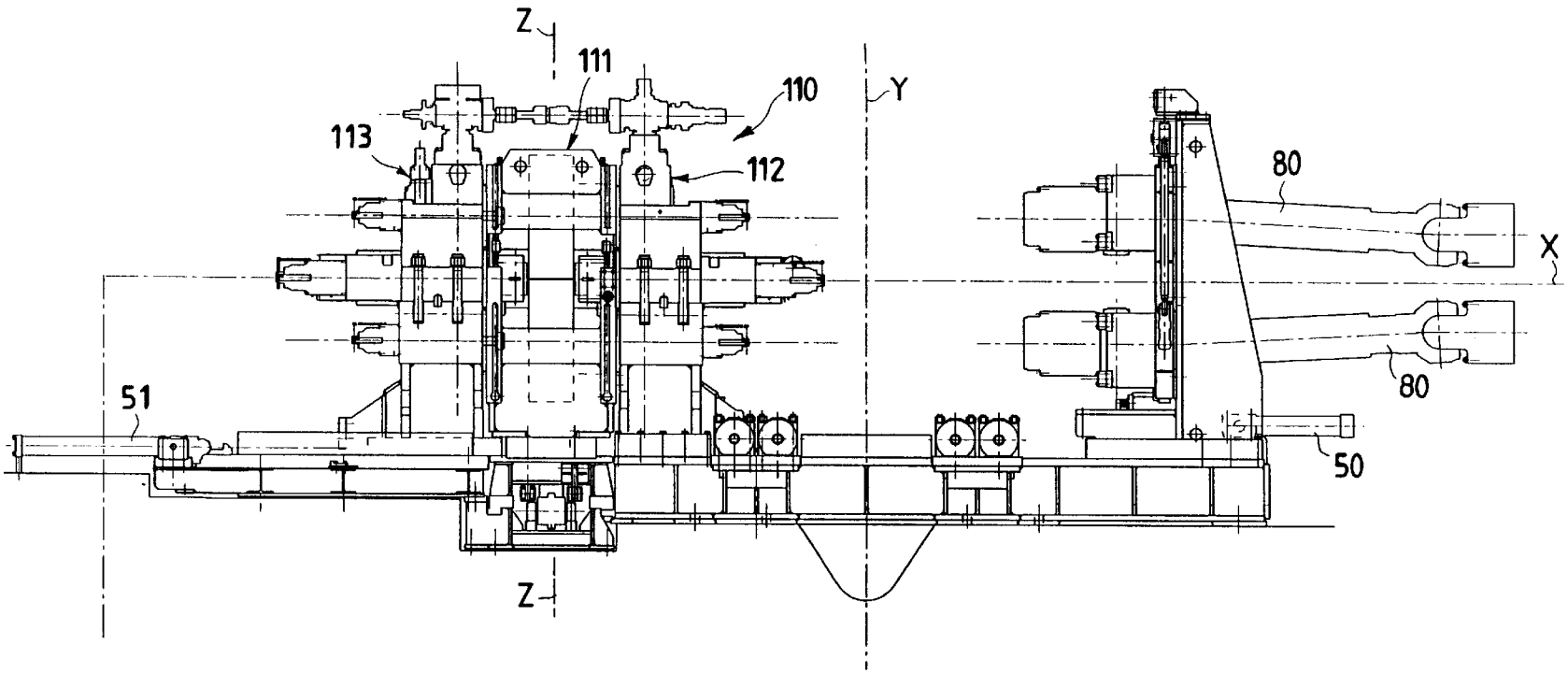
Figure 14:
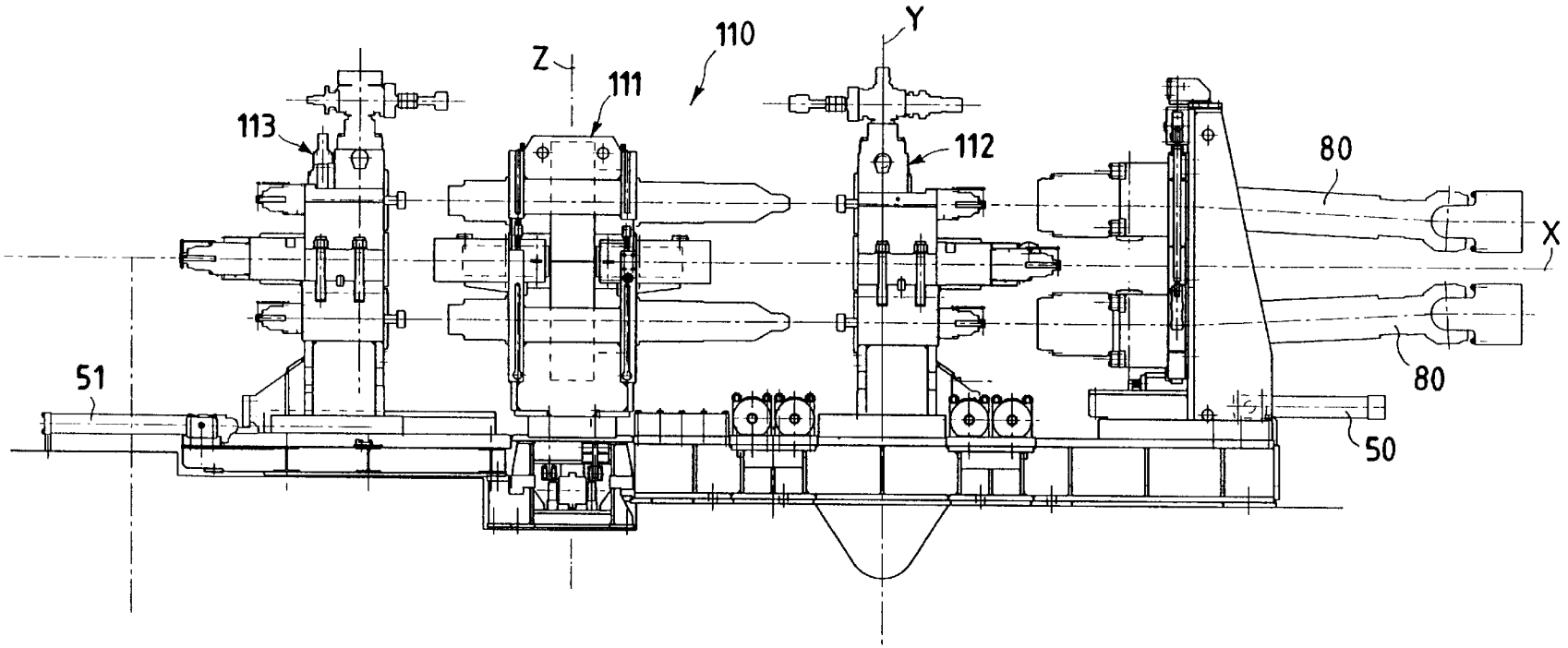
Figure 15:
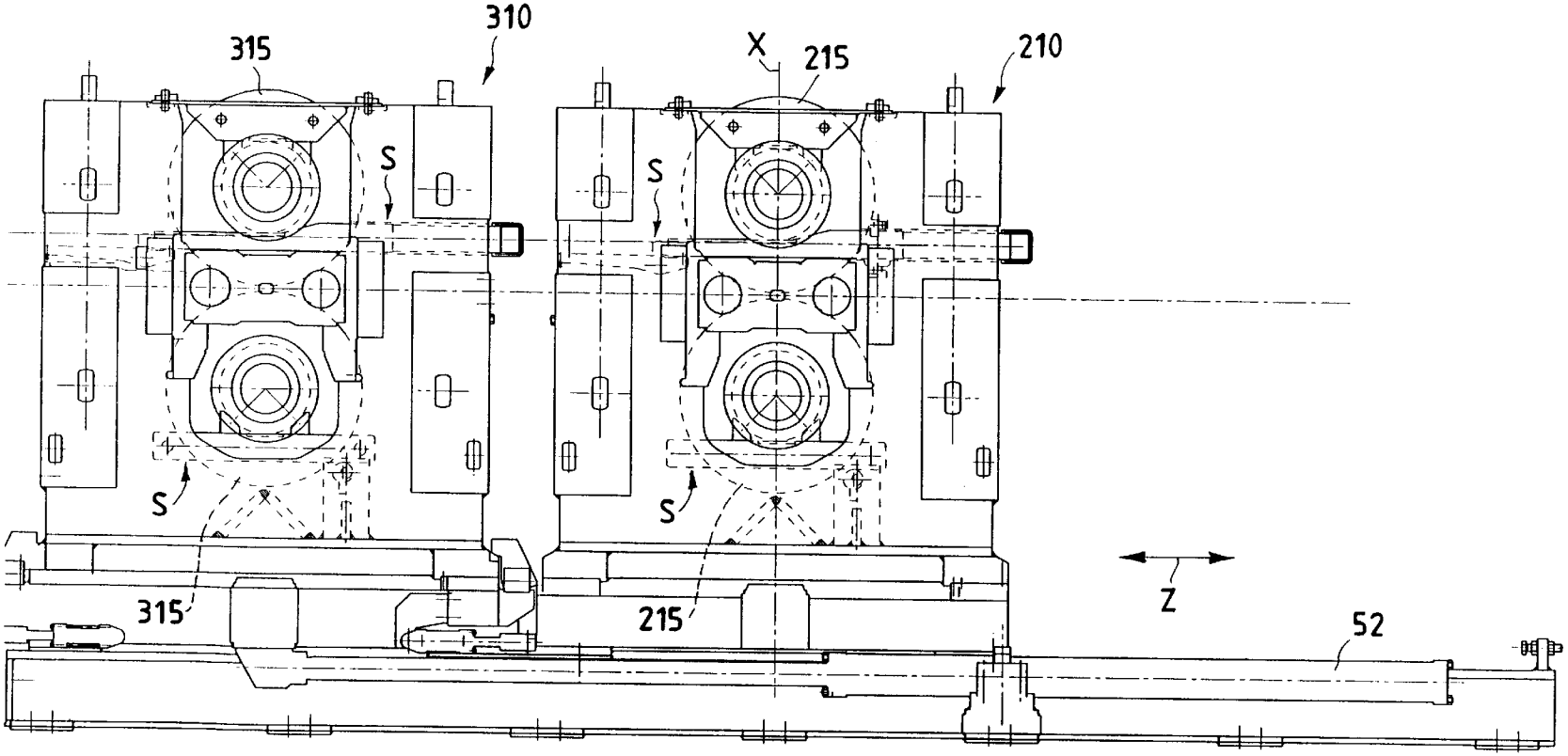

FIGS. **5*a*–5*f*** are schematic views illustrating the inventive idea and the phases involved in the replacement of the rolls in a rolling-mill stand built according to the principles of the invention;

FIG. 6 is a schematic view illustrating a two-high stand in the working position on the rolling axis:

FIG. 7 is a plan view of FIG. 6;

FIG. 8 is a view of the stand of FIGS. 6 and 7, translated from the rolling axis onto the roll-change axis;

FIG. 9 is a view illustrating the stand of FIG. 8 opened, i.e., with the side shoulders separated from the central core;

FIG. 10 is a schematic elevation view illustrating two central cores of a stand, one bearing the worn rolls, and the other bearing the new rolls, set on the roll-change axis in the phase illustrated in FIG. **5*d*;**

Figure 21:
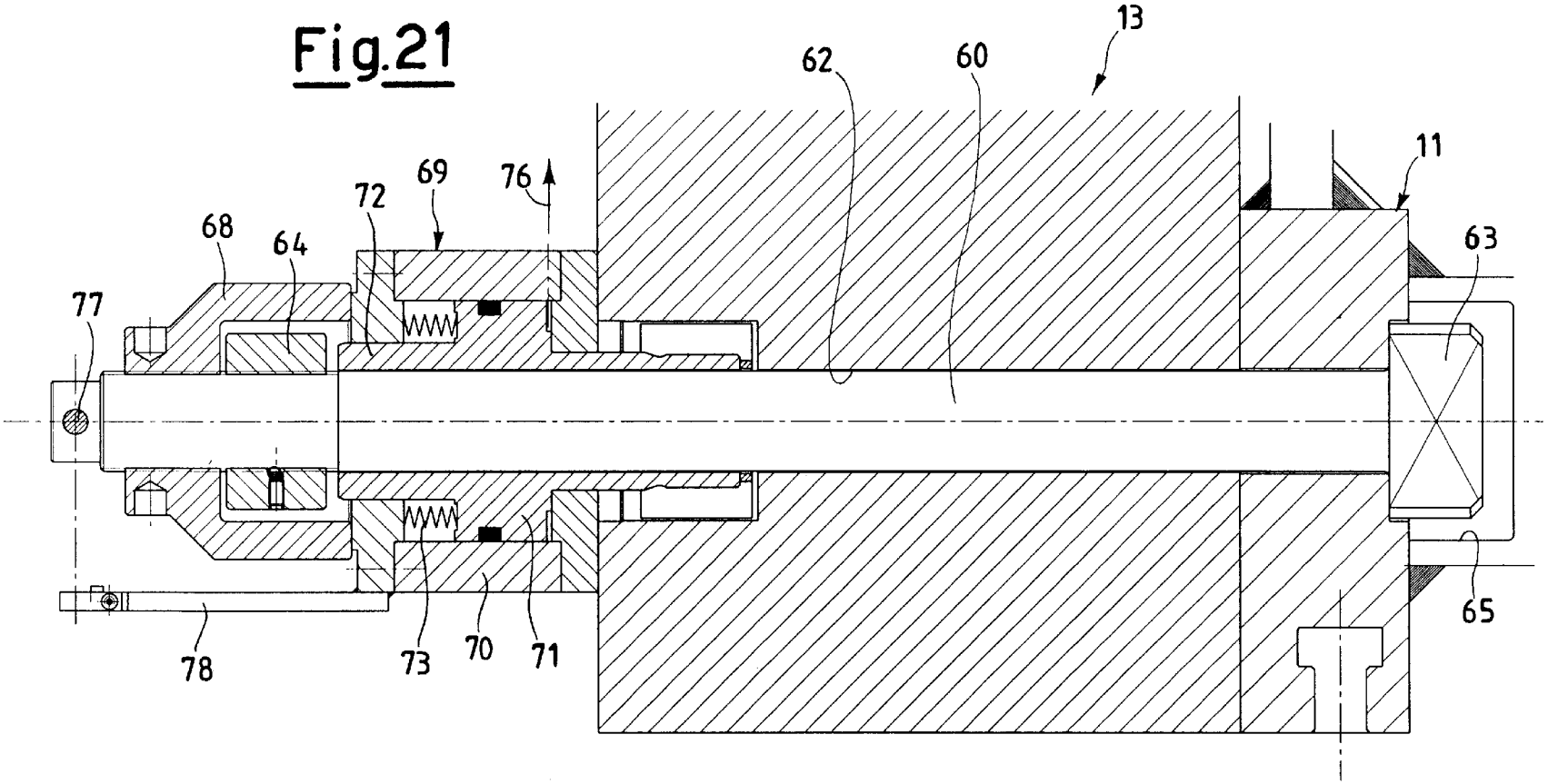
Figure 22:
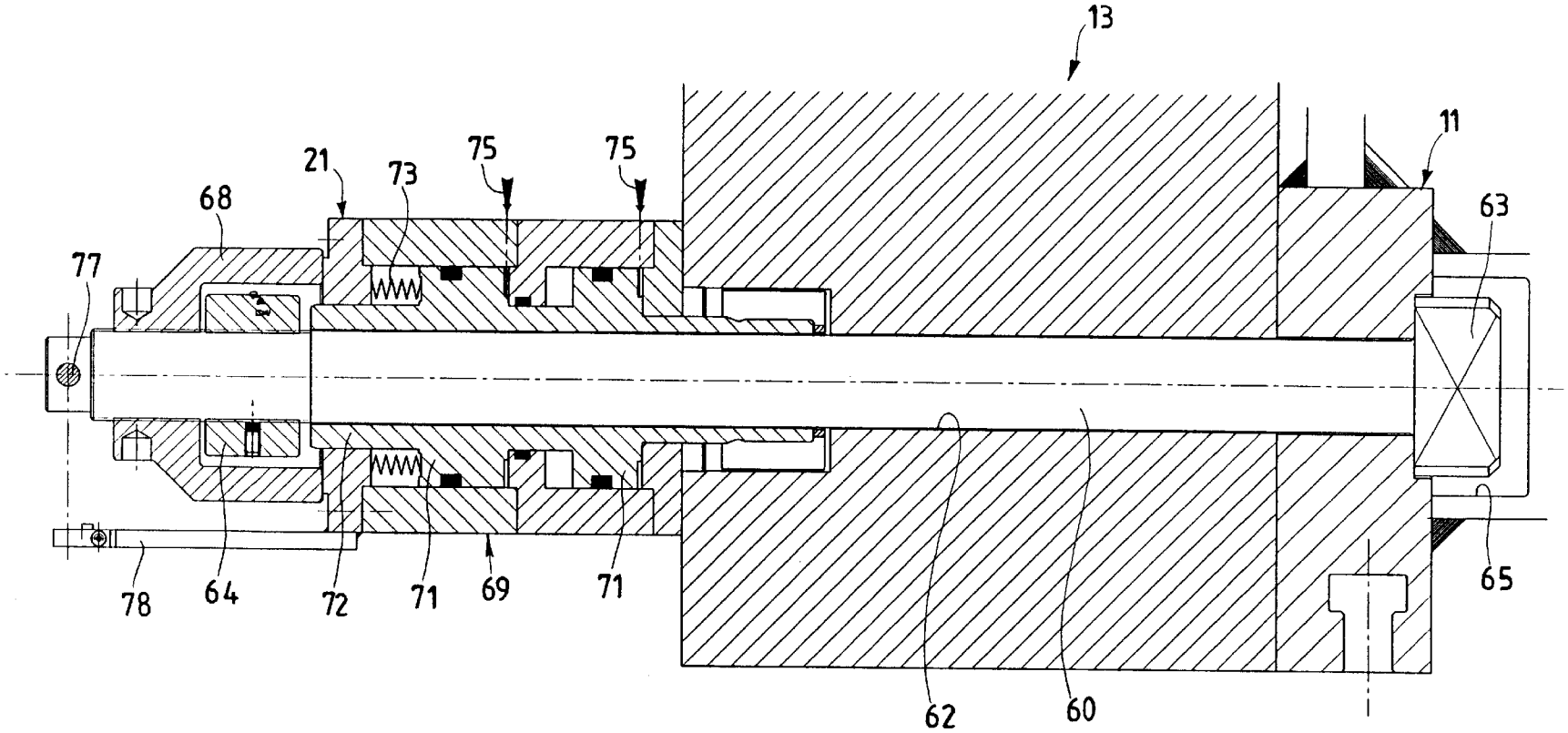

FIGS. 11–15 are views like FIGS. 6–10, but referring to a universal stand;

FIGS. 16–21 are schematic sectional views illustrating a possible system of fast clamping and release of the core to/from the shoulders of the stand in the different operating steps; and FIG. 22 is a variant of the system of FIGS. 16–21.

Figure 1:
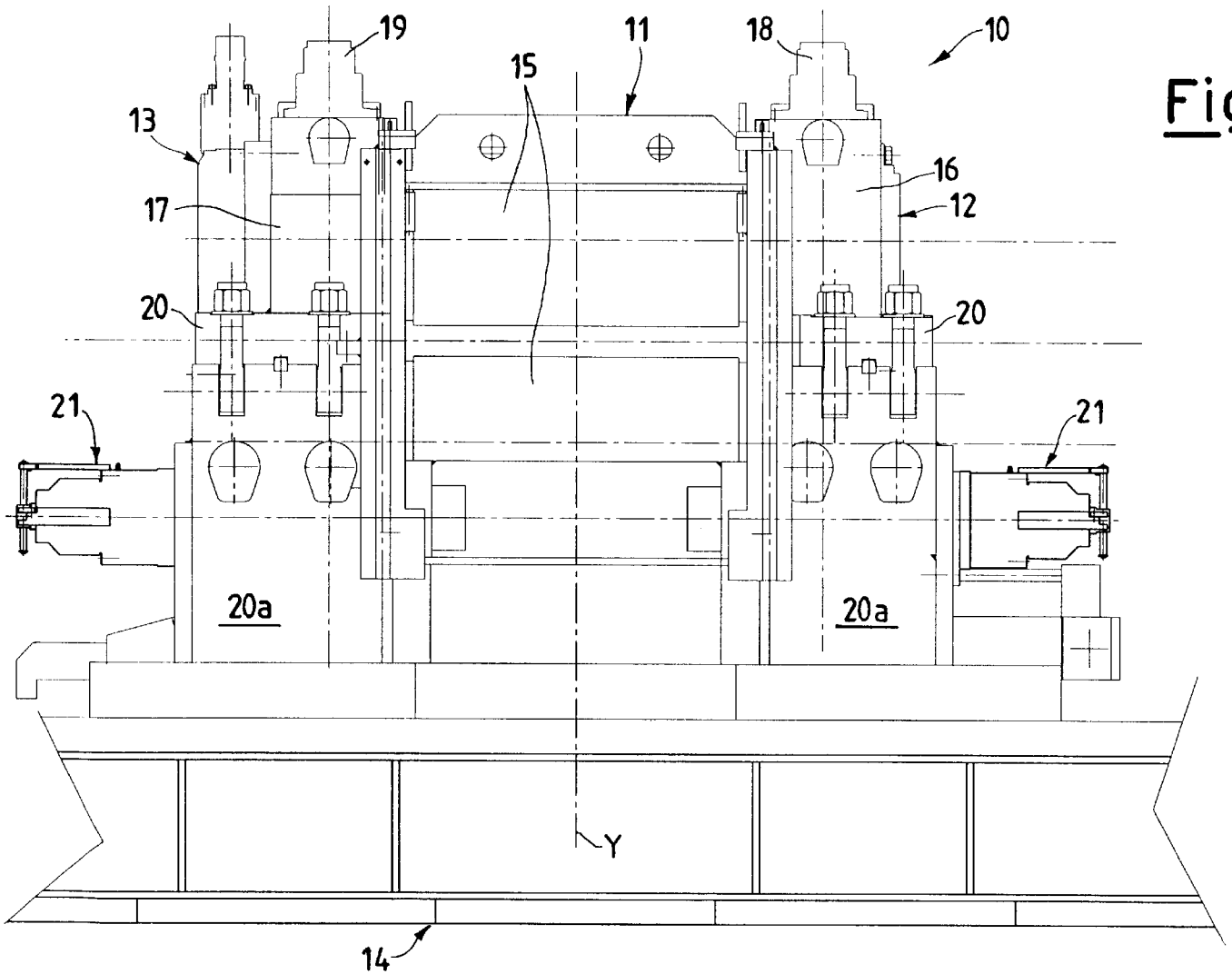
FIGS. 1 and 2 are two schematic views illustrating, respectively, a two-high stand and a universal stand, both built according to the principles of the invention.

Referring first of all to FIG. 1 of the drawings, a separable rolling-mill stand according to the invention (two-high stand type) is designated as a whole by 10 and is structurally made up of three modular elements interconnected in a separable way, i.e., a central module (core) 11 and two side modules (shoulders) 12, 13, all resting on a base 14.

The central module 11 carries the rolls, for example a pair of horizontal rolls 15, if it is a two-high stand, whilst the side modules 12, 13 carry all the other elements of the stand, namely the mounts 16, 17 which support the rolls 15, with the corresponding adjustment tie rods 18, 19, the supporting feet 20, and the corresponding supports **20*a* fixed to the base 14 during rolling (FIG. 1**).

Designated as a whole by 21 are two fast-clamping and fast-release systems which will be described in detail in what follows and which have the function of interconnecting stably, but in an easily and rapidly separable way, the central module (core) 11 and the side modules (shoulders) 12, 13.

Figure 2:
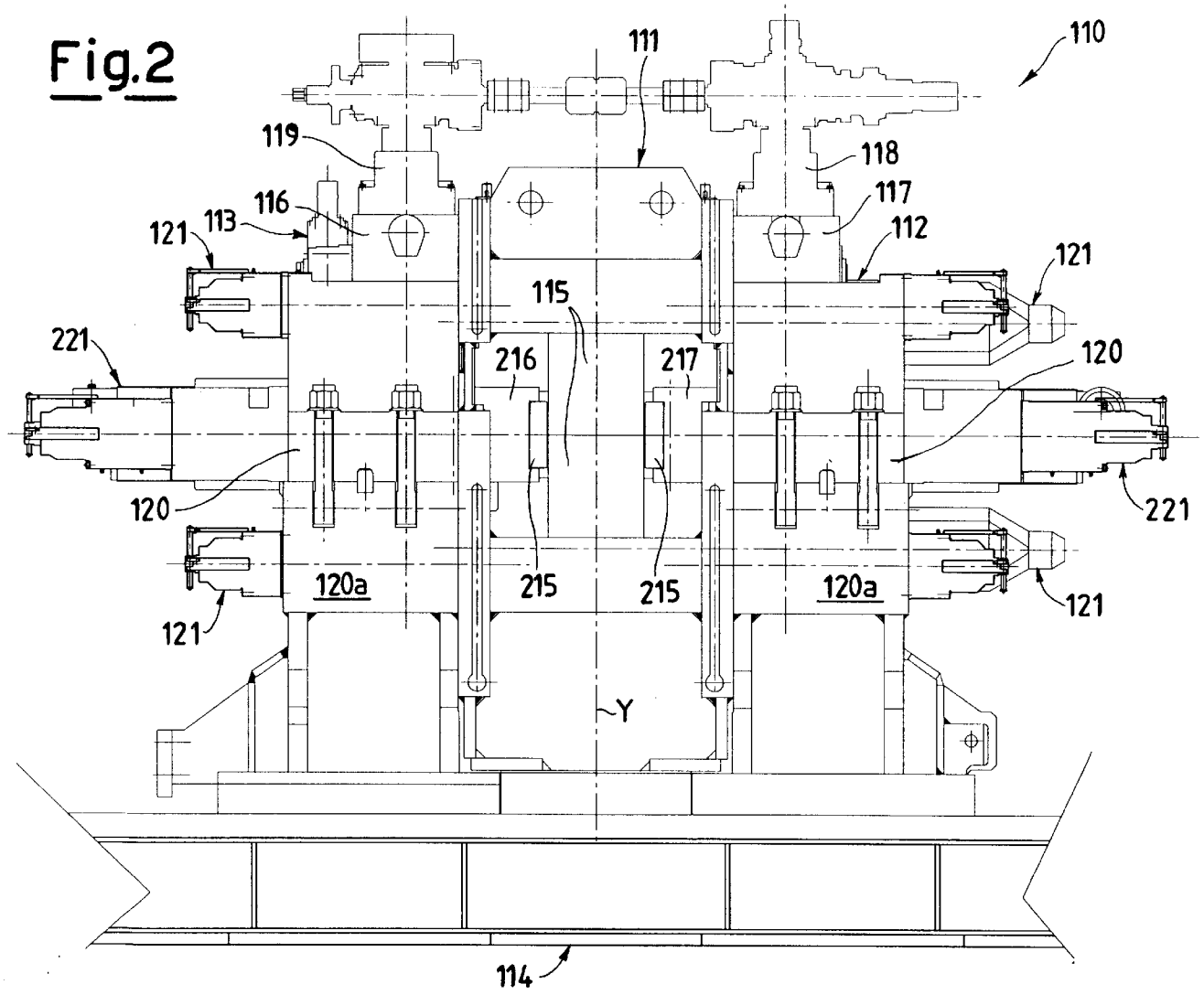
Figure 3:
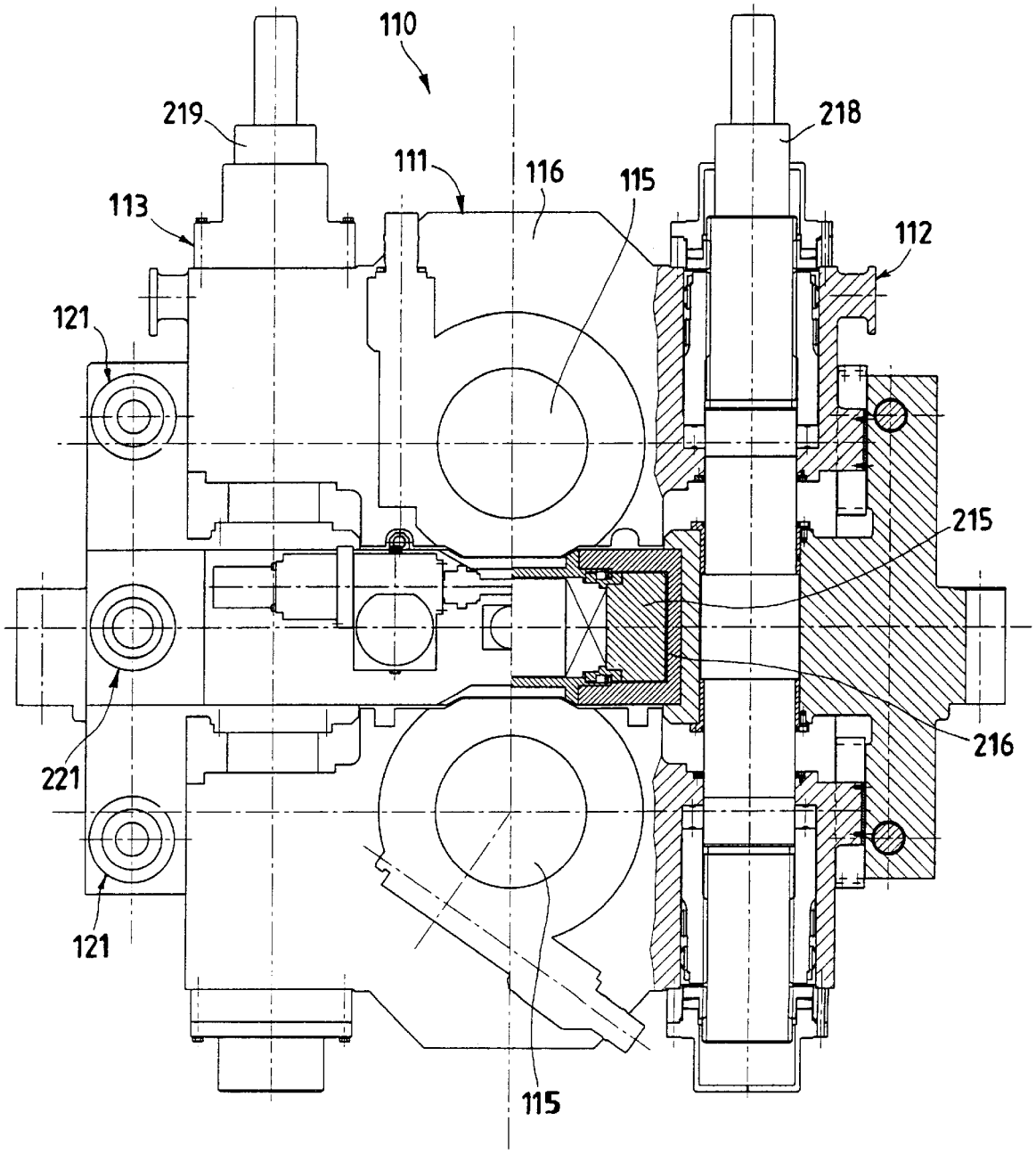
FIG. 3 is a partially sectioned elevation view of the universal stand of FIG. 2.

FIGS. 2 and 3 of the drawings illustrate a universal stand 110 built according to the invention, which comprises, like the two-high stand 10 illustrated in FIG. 1, a central module (core) 111 and two side modules (shoulders) 112, 113.

Figure 4:
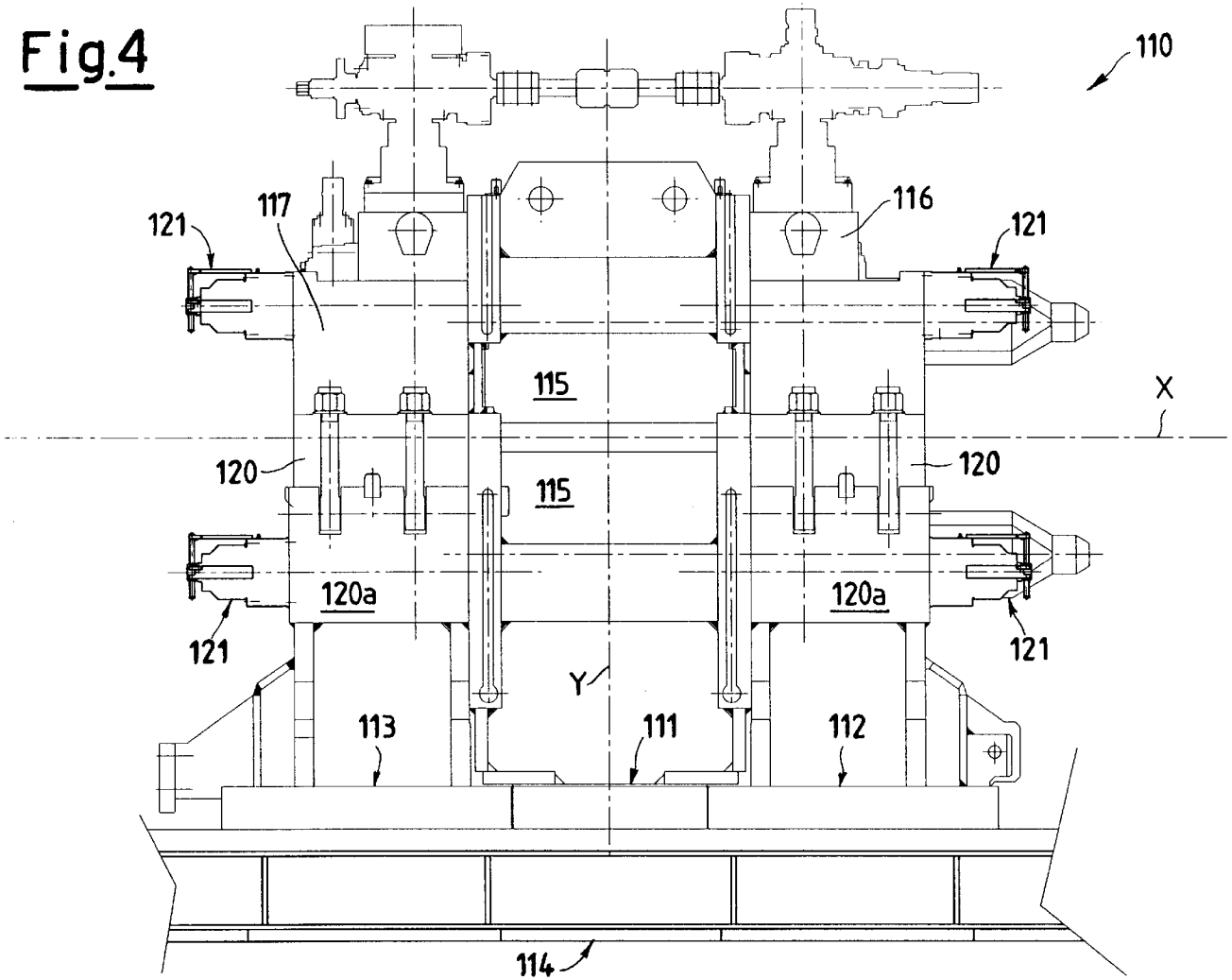
FIG. 4 is a view of the universal stand of FIG. 2, transformed into a two-high stand.

The central module 111 carries two pairs of rolls 115, 215, respectively horizontal and vertical, whilst the side modules 112, 113 carry mounts 116, 117 for the horizontal rolls 115, and mounts 216, 217 for the vertical rolls 215, with corresponding adjustment tie rods 118, 119 and, respectively, 218, 219, and supporting feet 120 and corresponding supports 120*a*. In FIGS. 2 and 3, by 121 and, respectively, 221, are indicated the clamping systems for the horizontal rolls 115 and the clamping systems for the vertical rolls 215. FIG. 4 of the drawings illustrates the universal stand of FIGS. 2 and 3 converted into a two-high stand by removal of the pair of vertical rolls 215 with corresponding mounts, tie rods and clamping systems. With a stand 10, 110 consisting of modular elements 11, 111, 12, 112, 13, 113, according to the invention, replacement of the rolls can be carried out as shown in sequence in FIGS. 5*a*–5*f* using only an overhead travelling crane even of limited hoisting power, which is normally present in all traditional rolling mills. In FIGS. 5*a*–5*f*, X indicates the axis of the reduction gear that transmits motion to the rolls, Y indicates the rolling axis, and Z indicates the axis of roll change, which is interspaced at the sides of and parallel to the rolling axis Y.

Figure 5A:
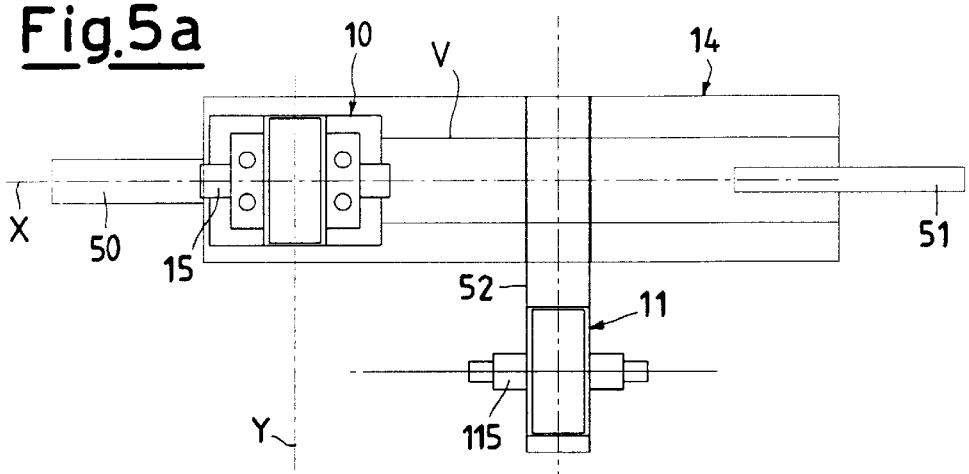
Figure 5B:
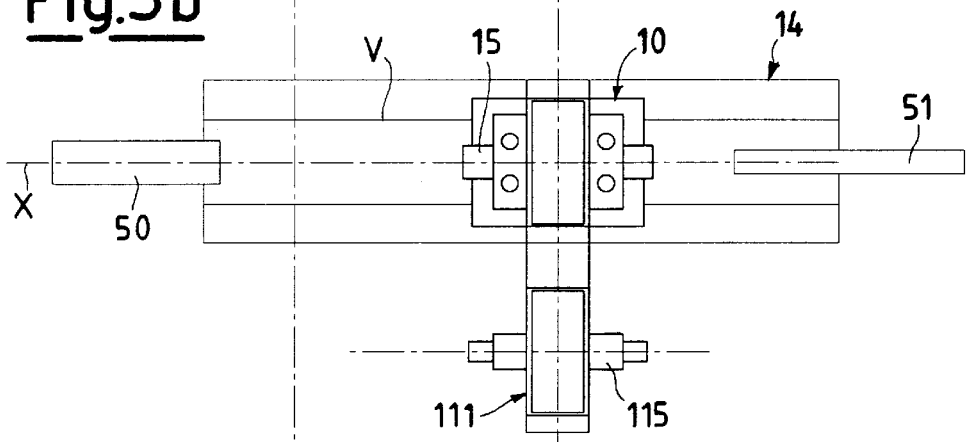

The rolling-mill stand, for example the two-high stand 10, is first of all displaced off the rolling line, along runways V built into the base 14 by means of a pusher or ejector (for instance, a hydraulic cylinder 50) from the position of FIG. 5*a* to the position of FIG. 5*b* on the roll-change axis Z.

Figure 5C:
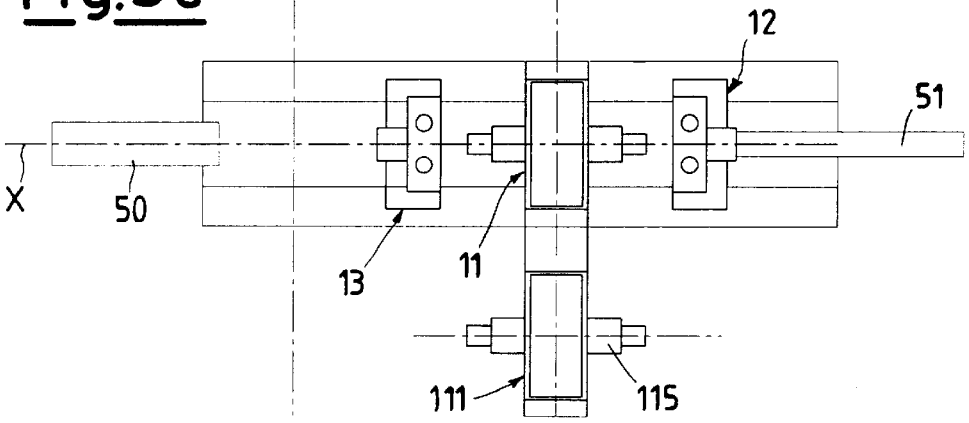

The stand 10 is opened, as shown in FIG. 5*c* (using, on the one side, the pusher cylinder 50 itself, and, on the other side, another cylinder 51); i.e., the side modules (shoulders) 12, 13 are separated from the central module (core) 11 so as to lay bare the worn rolls 15 of the central module 11, whilst a reserve central module 111 provided with new rolls 115 is waiting on the same roll-change axis Z, as shown in FIG. 5*c*.

Figure 5D:
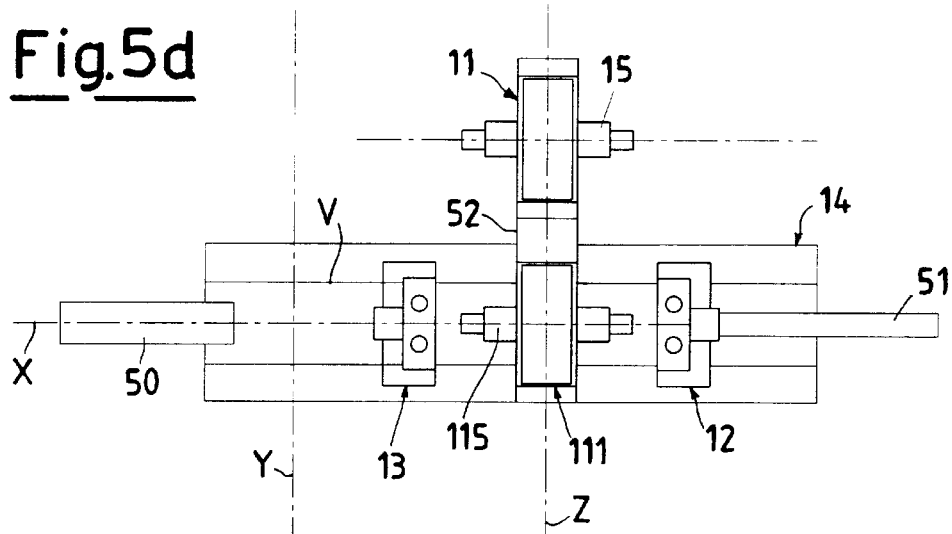
Figure 5E:
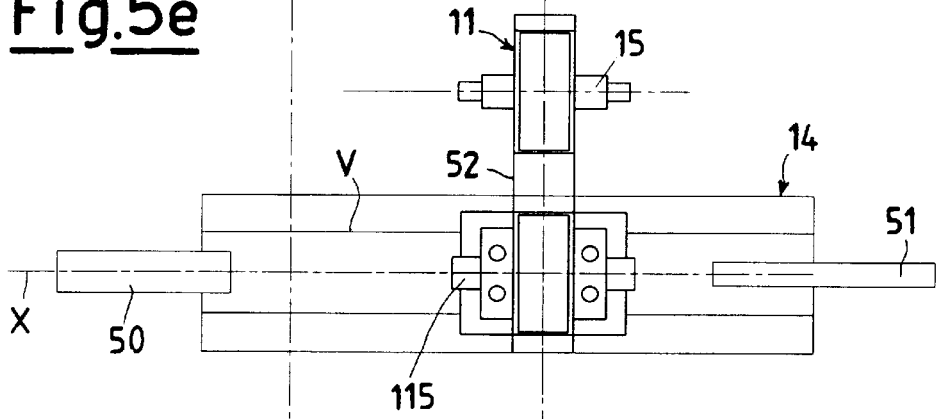
Figure 5F:
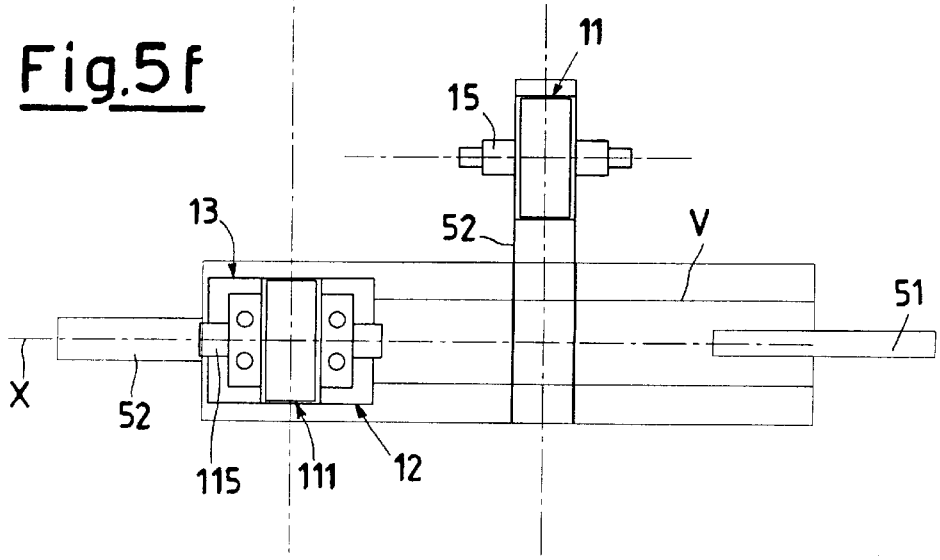

The module 11 with the used rolls 15 and the module 111 with the new rolls 115, by means of a translator carriage T moved by a hydraulic cylinder 52 (FIG. 10), are translated simultaneously, on the roll-change axis Z, into the position shown in FIG. 5*d*. Consequently, the central module 111 comes to be set between the side modules 12, 13 (FIG. 5*d*), which are closed onto it (FIG. 5*e*), so as to form a rolling-mill stand with new rolls 115, which is then taken back, once again using the cylinder 50, onto the rolling axis Y (FIG. 5*f*). Instead, the module 11 remains off the line on the roll-change axis Z, where the used rolls 15 can be replaced. It is to be noted that, when the stand is opened, i.e., when the central module (core) is separated from the side modules (shoulders), the rolls, released from the mounts, are supported by supporting means, represented schematically by S in FIGS. 10 and 15, which can be of any type suited to the purpose.

The positions assumed by the various components in the operating steps, illustrated schematically and described with reference to FIGS. 5*a*–5*f* of the drawings, are illustrated in greater detail also in FIGS. 6–15, where 80 designates the so-called extensions through which the motion is transmitted to the rolls.

With reference to FIGS. 16–21, the fast-clamping and release system is hereinafter described. This system has the purpose of joining stably together, in a separable way, the three modules 11, 12, 13; 111, 112, 113. Of course, the systems 121, 221 are the same as the system 21 described below.

The system 21 is structurally made up of a tie rod 60, which freely traverses two aligned holes 61, 62, provided, respectively, on the central module (core) 11 and on the side modules (shoulders) 12, 13.

As emerges clearly from the drawings, the said tie rod 60 is provided, at its opposite ends, with a head 63 and a stop collar 64.

The head 63 is integral with the tie rod 60 and is seated in the housing 65 of the central module 11, whilst the stop collar 64 is screwed in a position-adjustable way on the threaded end 67 of the tie rod 60 opposite to the head 63. A grub screw 66 blocks the stop collar 64 in position.

Screwed on the same threaded end 67 is a locking ring nut 68, the function of which will be explained in what follows.

Between the said ring nut 68 and the said side module (shoulder) 13, on the tie rod 60, a hydraulic actuator 69 is mounted.

The said hydraulic actuator 69 comprises a cylinder 70, which is fixed to the module 13 by means of a set of screws and inside which there moves a piston 71 provided with a stem 72 which translates along the tie rod 60 and which extends with its opposite ends outside the cylinder 70.

Displacement of the piston 71, against the action of a counter spring 73, occurs in one direction by immission of oil under pressure into a chamber 74, as represented by the arrow 75.

Displacement of the piston 71 in the opposite direction is, instead, effected by the counter spring 73, thus discharging the chamber 74, as represented by the arrow 76.

Figure 16:
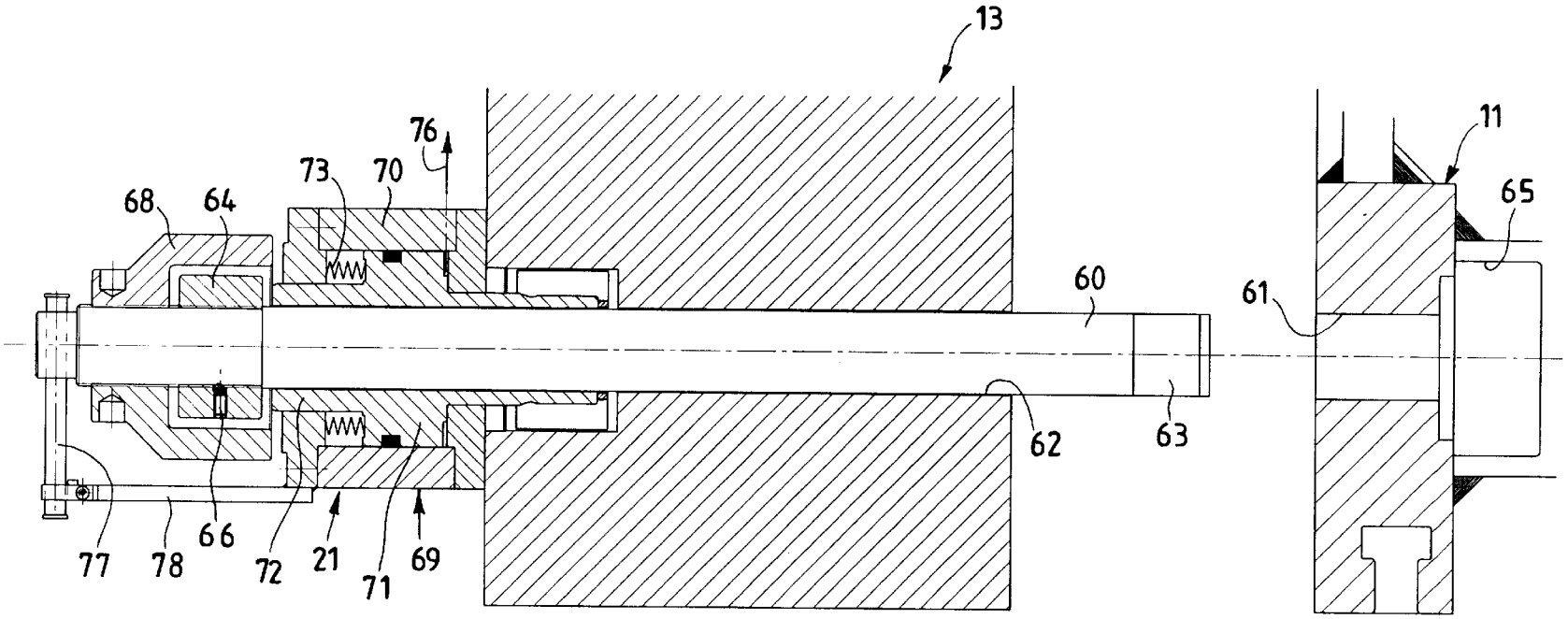

Operation of the above-described system of fast clamping and release performed according to the invention emerges clearly from the figures and in brief is as follows: Assuming that the stand is to be reassembled by the stable union between the central module 11 and the side modules 12, 13, (referring to module 13 alone) the central module 11 and the side module 13, from the separated position of FIG. 16, are coupled together in the position of FIG. 17 by means of insertion of the head 63 into the housing 65 of the central module 11. The head 63 is constrained to the housing 65 by means of a 90° rotation of the stem 60 from the position of FIG. 17 to the position of FIG. 18.

Figure 17:
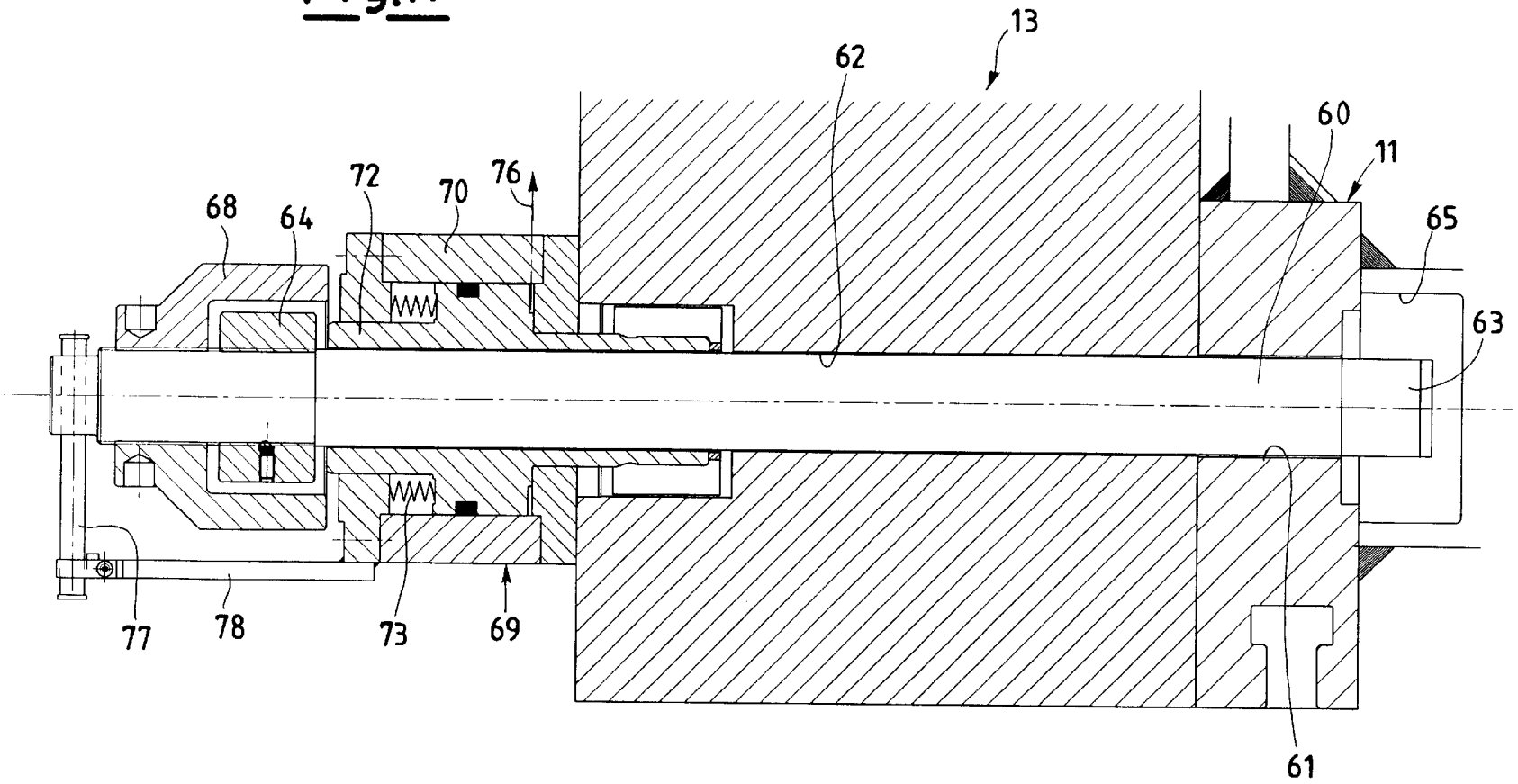
Figure 18:
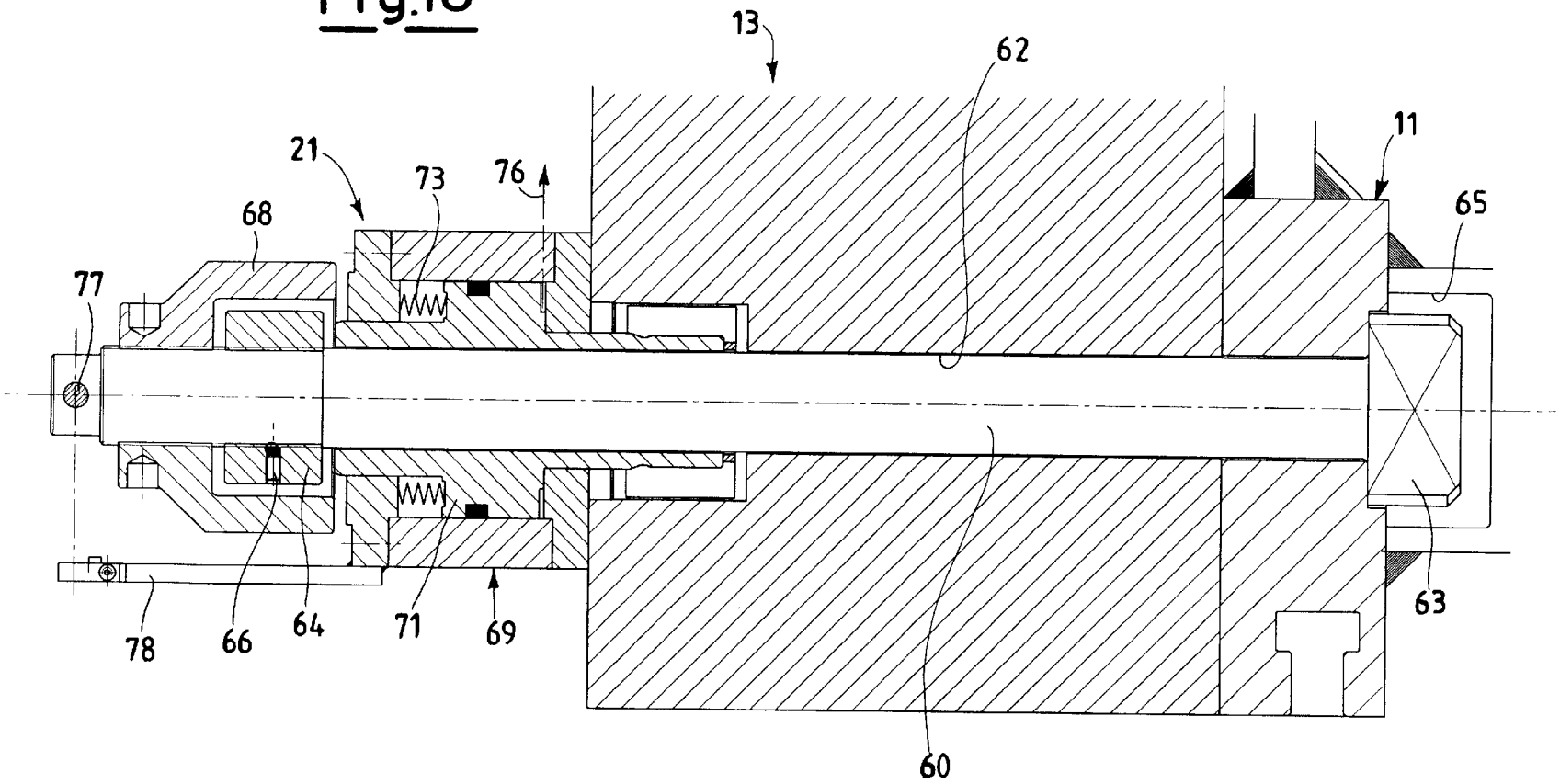

For this purpose, the stem 60 at the opposite end to the head 63 is provided with a control lever 77 which, in the position of FIGS. 16 and 17, co-operates with a reference stop 78 which extends from the cylinder 70. With the head 63 in this position, oil is introduced under pressure into the chamber 74, as represented by the arrow 75 (FIG. 19), after which the locking ring nut 68 is tightened against the cylinder 70 (FIG. 20) so as to stably block, packing them together, the central module (core) 11 and the side module (shoulder) 13.

Figure 19:
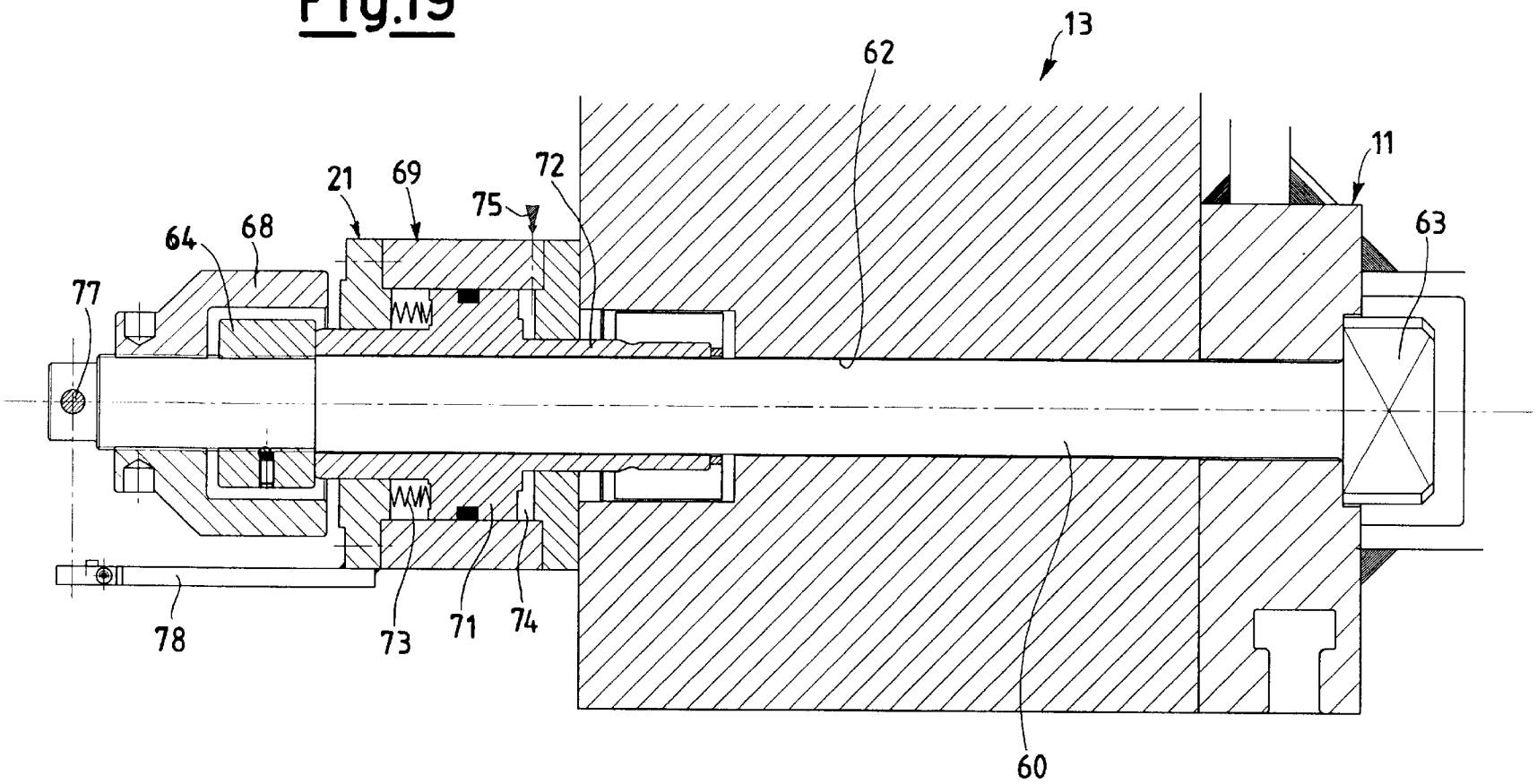
Figure 20:
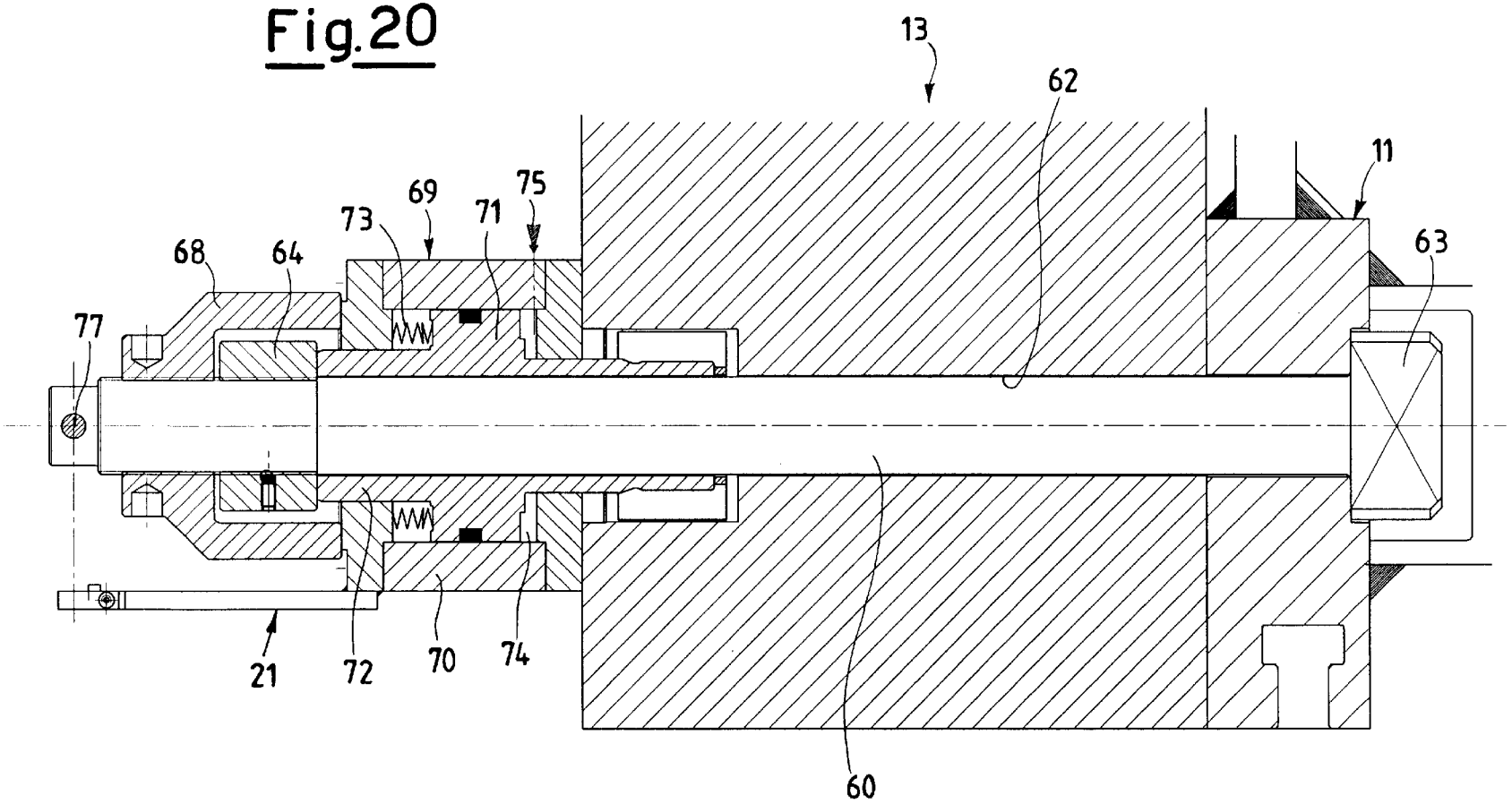

Immission of oil into the chamber 74 actuates clamping pre-charge between the components 11, 13, so enabling a convenient manual manoeuvring of the locking ring nut 68, after which oil under pressure is discharged from the chamber 74, as represented by the arrow 76 (FIG. 21), so that the counter spring 73 displaces the piston 71 from the position of FIG. 19 to the position of FIG. 21.

The stand is in the operating condition, without any danger whatsoever of slackening between the core and the shoulders due to oil leakages from the chambers under pressure, as may occur in known systems.

Of course, the same operation is carried out for the other side module 12.

A fast separation of the shoulder 12, 13 from the central core 11 (as indicated in FIGS. 5*a*–5*f*) may be carried out by performing, on the clamping system, the operations described above in reverse order.

FIG. 22 illustrates a system altogether equivalent to that of FIGS. 16–21, in which a double piston is present. This system is adopted in the cases where, on account of shortage of space, a piston having a relatively large diameter cannot be adopted.

In this way, it is possible to achieve the purpose mentioned in the preamble of the description, i.e., that of having a rolling-mill stand that is easy to take apart and to move using the equipment with which a rolling mill is traditionally equipped, namely, an overhead travelling crane having normal hoisting power and translator carriages.

It is to be noted that the invention makes it possible, advantageously, to have a single complete stand made up of a central module (core) and two side modules (shoulders), plus a central module (core) provided with new rolls, instead of the robot required for the replacement of the rolls in a stand of the traditional type.

Of course, it is also possible to carry out roll change on one and the same central module (core) displaced off the rolling line; this solution involves longer times but a lower investment, in that the reserve core and corresponding mechanisms for movement are not present. It should moreover be noted that in a universal-type stand built according to the invention it is possible to replace the horizontal and vertical rolls at the same time, or the horizontal rolls alone, as required. Furthermore, in a universal stand according to the invention, by removing the mounts that carry the vertical rolls, a two-high stand is immediately obtained, without any need to disassemble the shoulders or the mounts that carry the horizontal rolls. In this way, the purposes referred to in the preamble of the description are achieved.

The scope of protection of the present invention is defined by the ensuing claims.

What is claimed is:

1. A rolling-mill stand which comprises, in combination, at least two rolls (15) supported by mounts (16,17) having adjustment and blocking tie rods (18, 19), supporting feet (20) and supports **(20*a*), wherein said rolls (15) are mounted on a central module (11), while the corresponding mounts (16, 17), tie rods (18, 19), feet (20) and supports (20*a*) are mounted together in the form of two side modules (12, 13), there being provided a fast clamping and fast release system (21) for stable but separable connection between said central module (11) and said side modules (12, 13) wherein. said systems for fast-clamping and fast-release of said horizontal and vertical rolls (21, 121, 221) comprise a tie rod (60) which passes freely through two aligned holes (61, 62) which are provided respectively on said central module (11) and on said side modules (12 or 13); and having a head (63) which is integral with one end of said tie rod (60) which is seated on a housing of said central module (11), while on the opposite end, a stop collar (64) and locking ring nut (68) are screwed in a position-adjustable manner; and having between said ring nut (68) and said side module (12, 13) on said tie rod (60) is mounted a hydraulic actuator (69) comprising a cylinder (70) inside of which is located a moving piston (71) which is provided with a stem (72), said stem (72) being connected to said tie rod (60) and extending with its opposite end outside of said cylinder (70), the displacement of said piston (71) being actuated by introducing oil under pressure into a chamber (74) against the action of a counter spring (73)**.

* * * * *